United States Patent [19]

Anazawa et al.

[11] Patent Number: 4,488,045

[45] Date of Patent: Dec. 11, 1984

[54] METAL ION SOURCE

[75] Inventors: Norimichi Anazawa; Masahiko Okunuki; Ryuzo Aihara, all of Tokyo, Japan

[73] Assignee: JEOL Ltd., Tokyo, Japan

[21] Appl. No.: 412,215

[22] Filed: Aug. 27, 1982

[30] Foreign Application Priority Data

Sep. 3, 1981 [JP] Japan ..... 56-139093

[51] Int. Cl.[3] ..... H01J 27/02

[52] U.S. Cl. ..... 250/423 R; 313/362.1

[58] Field of Search ..... 250/423 R; 313/163, 313/362.1, 328, 232; 315/111.81

[56] References Cited

U.S. PATENT DOCUMENTS

| | | | |
|---|---|---|---|
| 3,233,404 | 2/1966 | Huber et al. | 313/362.1 |
| 4,088,919 | 5/1978 | Clampitt et al. | 313/362.1 |
| 4,318,029 | 3/1982 | Jergenson | 250/423 R |
| 4,318,030 | 3/1982 | Jergenson | 313/362.1 |
| 4,328,667 | 5/1982 | Valentian et al. | 313/163 |
| 4,367,429 | 1/1983 | Wang et al. | 250/423 R |

*Primary Examiner*—Bruce C. Anderson

*Attorney, Agent, or Firm*—Webb, Burden, Robinson & Webb

[57] ABSTRACT

A reservoir containing a material to be ionized has in its bottom a capillary extending outwardly in symmetrical with the optical axis of an ion source, and has a needle extending coaxially through said capillary in said reservoir so that the apex end of the needle projects slightly beyond the exterior surface of the reservoir. Intensive electric field at the apex end of the needle is formed by an extracting electrode disposed in facing the needle. An electric current is supplied through conductive wires or filaments supporting the reservoir for heating the reservoir. As a result, the liquid material to be ionized in the reservoir seeps smoothly through the capillary of the reservoir toward the apex end of the needle for field evaporation and ionization.

13 Claims, 7 Drawing Figures

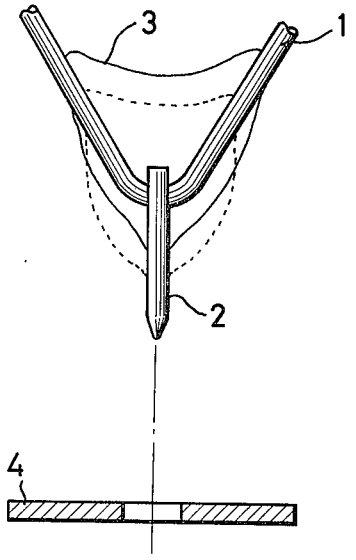
Fig. 1
PRIOR ART
Fig. 3
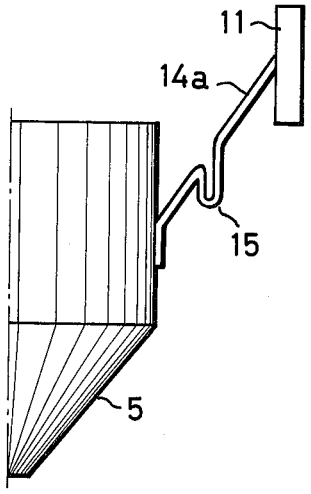
Fig. 2
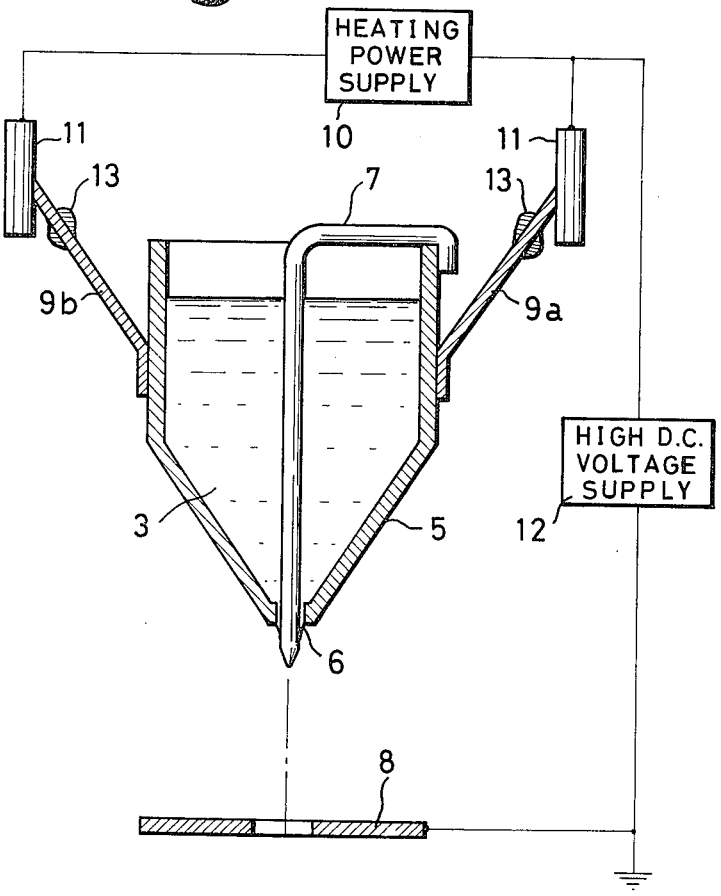
Fig. 4
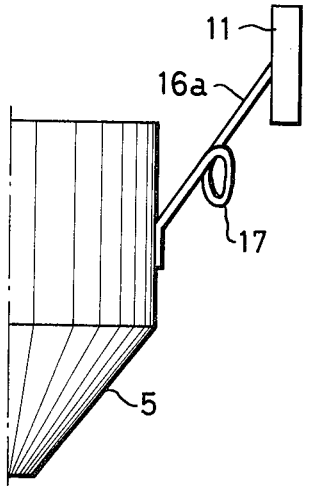

METAL ION SOURCE

BACKGROUND OF THE INVENTION

The present invention relates to a metal ion source, and more particularly to an ion source capable of producing a stable ion beam for an extended period of time.

A known metal ion source for generating a beam of gallium ions includes a curved tungsten filament and an emitter spot-welded to the tungsten filament. A mass of gallium, for example, is held by the curved tungsten filament for flowing down the emitter toward its pointed end for field evaporation and ionization. The amount of gallium which can flow and be ionized varies with the amount thereof held by the filament, with the result that the ion source cannot produce a stable ion beam for an extended period of time.

SUMMARY OF THE INVENTION

It is a principal object of the present invention to generate a metal ion beam stably for an increased period of time.

Another object of the present invention is to minimize unnecessary consumption of a material to be ionized.

According to the present invention, a metal ion source comprises: (a) a reservoir for containing a material to be ionized, the reservoir having in its bottom a capillary (tubular passage) extending outwardly in symmetrical relation to an optical axis of the metal ion source; (b) a needle extending coaxially through the capillary in the reservoir and having a pointed end projecting beyond an outer surface of the reservoir; (c) a plurality of conductive wires or filaments supporting the reservoir; (d) an extracting electrode having an opening and being disposed facing the capillary in the reservoir; (e) a grounded electrode disposed below the extracting electrode; (f) a DC voltage supply for maintaining the reservoir at a positive high potential with respect to the grounded electrode; (g) an extracting voltage supply for maintaining the extracting electrode at a negative potential with respect to the reservoir; and (h) a heating power supply for supplying an electric current through the plurality of wires or filaments to heat the reservoir.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 1 is a schematic diagram illustrative of a conventional metal ion source;

FIG. 2 is a schematic diagram of a metal ion source according to an embodiment of the present invention;

FIGS. 3 through 5 are fragmentary schematic diagrams showing metal ion sources according to other embodiments of the present invention;

DETAILED DESCRIPTION

Figure 6:
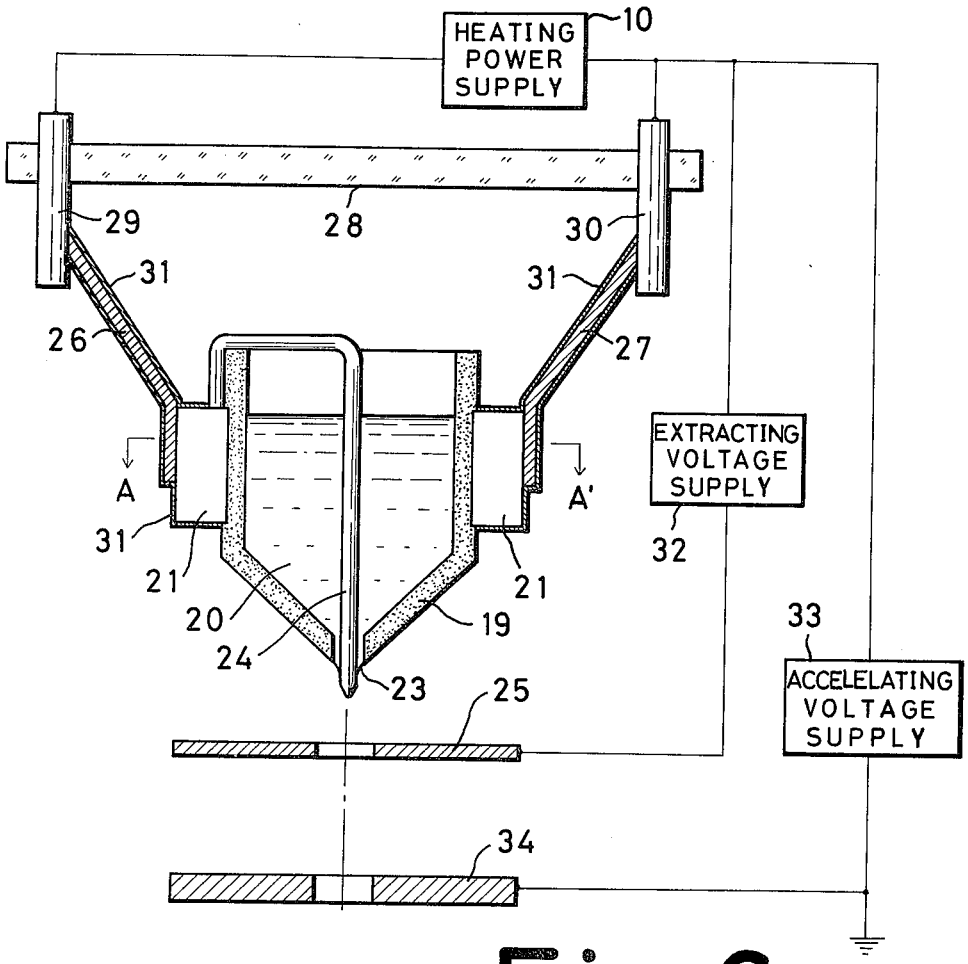
FIG. 6 is a schematic diagram of a metal ion source according to still another embodiment of the present invention.

FIG. 1 shows a conventional metal ion source including a tungsten filament 1 having a lower curved portion to which an emitter 2 of tungsten is spot-welded, the emitter 2 having a pointed end. A mass 3 of gallium (which has a melting point of 30 degrees Celsius) is retained in the V-shaped space defined by the lower curved portion of the tungsten filament 1. A grounded electrode 4 is disposed below the emitter 2 in spaced relation. The grounded electrode 4 is, of course, maintained at the ground potential. When a positive high voltage is applied on the emitter 2, the gallium on the distal end thereof is evaporated as gallium ions under an applied electric field. A stable beam of gallium ions cannot, however, be produced unless the gallium ions are held at a temperature higher than a certain temperature. More specifically, liquid metal such as gallium generally flows along the surface of a material due to thermal diffusion at a diffusion rate which varies with temperature. When the temperature is relatively low, the diffusion rate is small. No diffusion takes place when the temperature is below a certain point. The diffusion progresses from a location where the temperature is relatively high toward a location where the temperature is relatively low. When the gallium is at a low temperature, the passage along which the gallium flows toward the distal end of the emitter 2 along its surface has an increased flow resistance, with the result that the flow of gallium toward the emitter end for field evaporation becomes unstable and interrupted, and the ion beam produced is rendered unstable. To cope with this difficulty, heat conducted from the filament 1 is utilized to heat the mass 3 of gallium and the emitter 2 for stable and continuous tranfer of the gallium toward the distal end of the emitter 2.

However, since the filament 1 has a portion serving as a reservoir for holding the mass 3 of gallium, the effective electric resistance of the filament 1 (i.e., the resistance thereof between ends thereof) varies with the amount of gallium thus held on the filament 1, and so does the temperature of the filament 1. Therefore, the temperature of the liquid metal also varies, causing fluctuations in the amount of gallium which flows toward the emitter end. The positive high voltage applied to the emitter 2 during ion beam generation produces an electrostatic stress normal to the surface of the lobe-shaped mass of gallium held by the filament 1, forcing the mass of gallium to flow toward the emitter end as shown by the dotted line until the electrostatic stress imposed is counterbalanced by the surface tension acting on the surface of the mass of gallium. As a result, the electrostatic field intensity at the emitter end is weakened, thereby reducing gallium ion beam current which is produced at the emitter end. The exact shape of the mass 3 of gallium after it has been displaced under the electrostatic stress imposed varies with the amount of gallium held by the filament 1, and hence so does the degree by which the electrostatic field intensity at the emitter end is reduced. For the reasons described above, the conventional ion source as shown in FIG. 1 fails to generate a stable ion beam over a prolonged interval of time.

FIG. 2 shows a metal ion source constructed in accordance with an embodiment of the present invention. The metal ion source includes a funnel-shaped reservoir 5 made of tantalum, tungsten or other materials and has a capillary (tubular passage) 6 in its bottom. The reservoir 5 contains a metal such, for example, as a mass 3 of gallium. To fill the reservoir 5 with gallium, the empty reservoir is dipped in gallium liquid, and is cooled at room temperature, and then is installed in the ion source chamber. A needle 7 made of tungsten extends vertically through the capillary 6 and has one end spot-welded or otherwise secured to a side of the reservoir 5. The other end of the needle 7 is pointed by way of electrochemical etching. The apex end of the needle 7 is disposed above a grounded electrode 8 in confronting relation. A pair of tungsten filaments 9a, 9b are spot-welded to the reservoir 5, and are heated by currents supplied via stems or supports 11, from a heating power supply 10. A positive high voltage is applied by a high DC voltage supply 12 to the reservoir 5 and hence the needle 7.

In the ion source thus constructed, the gallium within the reservoir 5 seeps through the capillary 6 in the bottom thereof down toward the apex end of the needle 7. The gallium thus supplied to the end of the needle 7 forms a conical projection which is known as a "Taylor's cone." The electric field applied is concentrated on the apex end of the conical projection thus formed to cause the gallium on the cone end to evaporate under the electric field and be ionized as gallium ions. The ion source produces an ion beam having a high brightness, but fails to generate an ion beam stably unless the gallium to be ionized is kept at a certain temperature. More specifically, when the temperature of the gallium is relatively low, the mass of gallium which flows down the needle 7 toward its end is subjected to an increased resistance, and hence the gallium flow becomes unstable and discontinuous, resulting in an unstable beam of ions emitted from the ion source. Such a difficulty is eliminated by supplying an electric current to the wire or filaments 9a, 9b to heat the filament, and utilizing the heat conducted from the filaments 9a, 9b to heat the gallium in the reservoir 5 and on the needle 7, thereby enabling the gallium to flow out of the reservoir 5 stably and continuously toward the pointed end of the needle 7.

With the reservoir 5 and the liquid metal or gallium 3 contained therein being heated by the wire or filaments 9a, 9b, the effective electric resistance of the filaments 9a, 9b does not vary with the amount of the liquid metal held in the reservoir 5. Therefore, the ion source of the invention can heat the liquid metal at a more constant temperature as compared with the conventional ion source, with the consequence that the gallium can be supplied stably and continuously from the reservoir 5 to the apex end of the needle 7. When an intensive electric field is developed at the apex end of the needle 7, most of the liquid metal in the reservoir 5 undergoes no positional displacement under such an intensive electric field. Therefore, the intensive electric field at the needle end is not reduced but kept stable for stable emission of an ion beam for a long period of time.

When the ion source as shown in FIG. 2 is being operated for a prolonged period of time, the gallium in the reservoir 5 gradually seeps through the reservoir walls due to thermal diffusion and eventually finds its way along the wire or filaments 9a, 9b. The filaments 9a, 9b include portions kept at a lower temperature which are close to the stems 11. Since the diffusion rate of the gallium is greatly reduced at such portions of the filaments 9a, 9b, the gallium flow is stopped and masses 13 of gallium are formed on the filaments 9a, 9b at such filament portions. The gallium on the filaments 9a, 9b, particularly the gallium masses 13 serve to lower the effective electric resistance of the filaments 9a, 9b. The reduced effective resistance of the filaments 9a, 9b results in a lowered temperature to which the gallium in the reservoir 5 can be heated. Accordingly, the gallium cannot stably be supplied from the reservoir 5 toward the distal end of the needle 7, and a stable ion beam cannot be generated by the ion source. The gallium flow along the surfaces of the filaments 9a, 9b due to thermal diffusion accelerates the rate of consumption of the gallium in the reservoir 5 and hence shortens the service life of the ion source.

Figure 5:
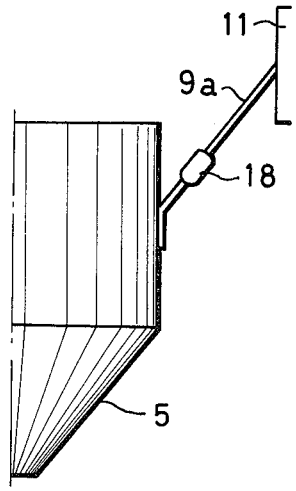

The above problem can effectively be solved by shaping the wire or filaments 9a, 9b so that they will have a localized region or zone which can be heated to a higher temperature. FIGS. 3 through 5 are illustrative of a variety of modified filaments designed to provide such high-temperature regions or zones.

In FIG. 3, a filament 14a (only one shown) includes a central U-shaped bent portion 15 which can be heated to a higher temperature than the temperature of the rest of the filament 14a because of mutual radiant heat generated by adjacent leg portions of the bent portion 15. As a consequence, the gallium which has seeped through the reservoir wall does not form a mass or body on the filament 14a since the bent portion 15 is kept at a temperature higher than that of the reservoir 5. No appreciable reduction in the effective electric resistance of the filament 14a is caused, and hence the mass 3 of gallium in the reservoir 5 can be heated to a desired temperature. The gallium can therefore be fed from the reservoir 5 to the distal end of the needle 7 stable for an increased period of time.

FIG. 4 illustrates another modification in which a filament 16a (only one shown) includes a central coil 17 that can be heated to a higher temperature than the temperature of the rest of the filament 16a due to radiant heat from adjacent portions of the filament 16a. The filament 16a therefore has the same advantages as those offered by the filament 14a shown in FIG. 3.

Another way of preventing the mass 13 of gallium from being formed on each of the filaments 9a, 9b (FIG. 2) is to use an insulator, which is poorly wet by liquid metal, on a portion of the filament or reservoir. FIG. 5 shows such a modification in which a filament 9a (only one shown) has a coating 18 of ceramics fused to a surface portion thereof near the reservoir 5. The ceramics have a poor affinity for liquid metal such as gallium, so that the liquid metal flowing along the filament 9a due to thermal diffusion is prevented by the ceramics sheet 18 from being diffused toward a low-temperature region of the filament 9a close to the stem 11. Consequently, no mass of liquid metal is formed on the filament 9a, and no serious reduction in the effective electric resistance of the filament 9a results.

The wires or filaments 9a, 9b used in the ion source are made of tungsten as described above. The resistance of tungsten has a large temperature coefficient ($5.3\times10^{-3}$/degree Celsius); the higher the temperature the greater the resistance, and the lower the temperature the smaller the resistance. Where the filaments 9a, 9b have different lengths or are joined to other parts through different areas, amounts of electric power supplied to the filaments 9a, 9b are different from each other, and hence the filaments 9a, 9b are heated to varying temperatures. With the resistance of tungsten dependent largely on temperature, the resistance of one of the filaments at a higher temperature is larger than that of the other filament, and the temperature difference between the filaments becomes larger. When the temperature of the filament 9a is higher than that of the filament 9b, for example, a flow of liquid metal occurs from the filament 9a to the filament 9b. As the liquid metal is diffused on the surface of the filament 9b, the temperature of the filament 9b is further lowered, and the temperature difference between the filaments becomes much greater, resulting in an accelerated rate of flow of the liquid metal toward the filament 9b. Such a liquid metal flow toward the filament 9b on account of the temperature of the filament 9a being higher than that of the filament 9b renders ion beam generation from the end of the needle 7 less stable, consumes the liquid metal at a greater rate, and shortens the service life of the ion source.

The foregoing difficulty can be overcome by using a material having a temperature coefficient of resistance which is $0.5\times10^{-3}$/degree Celsius or lower for the filaments 9a, 9b. Experiments conducted by the present inventors confirmed that by using filaments 9a, 9b made of nickel-chromium alloys or iron-chromium alloys having a temperature coefficient of resistance which is $0.1-0.5\times10^{-3}$/degree Celsius and much lower than that of tungsten, no temperature difference is caused between the filaments 9a, 9b, and no liquid metal flow occurs from one of the filaments to the other for a long period of time even if the filaments 9a, 9b are different in shape from each other.

The ion source as shown in FIG. 2 heats the metal used into a liquid state, and for this reason materials having a high melting point cannot be used by themselves as ionization materials. Since alloys generally have lower melting points than those of metals which the alloys are composed of, an alloy composed of a desired material of a high melting point to be ionized is placed into the reservoir and heated into a liquid state. For example, where ions of boron (B) having a melting point higher than 2,000 degrees Celsius are desired, an eutectic alloy composed of boron (B) and platinum (Pt) having a melting point of 795 degrees Celsius is heated into a liquid state, and an intensive electric field is applied to generate ions of Pt and ions of B. An ion beam composed of both ions is introduced into a Wien-type mass filter in which orthogonal electric and magnetic fields are generated to thereby separate ions of boron from ions of platinum. If a tungsten needle were used in such an ion source in which the alloy material is employed as an ionizing material, the surface of the needle would react with the liquid alloy and be melted into the latter. The ion beam generated would contain unwanted ions of the needle tungsten, which form a new alloy. Such a new alloy, for example Pt-B-W, in which tungsten is mixed has a high melting point and would be solidified into a mass at the melting point of the alloy Pt-B. The solidified mass would block smooth flow from the reservoir toward the distal end of the needle, impairing the stability of ion beam generation by the ion source.

Figure 7:
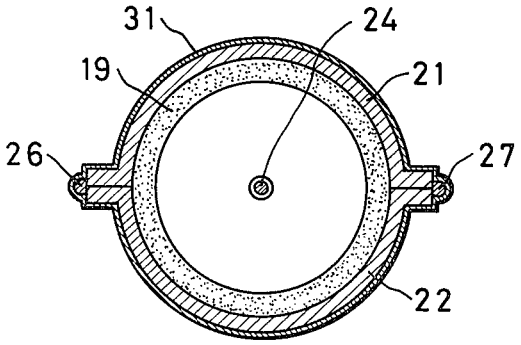
FIG. 7 is a transverse cross-sectional view taken along line A—A′ of FIG. 6.

FIGS. 6 and 7 are illustrative of an ion source of the type in which an alloy is heated to produce metal ions. In FIG. 6, the ion source includes a reservoir 19 containing a mass 20 of metal alloy (for example, Pt-B), the reservoir 19 being made of ceramics. Referring to FIG. 7, the reservoir 19 is supported in place of being surrounded by two plates 21, 22 of metal such as tantalum that is pliable or easily deformable. The two metal plates 21, 22 have ends abutting against and spot-welded to each other. The reservoir 19 has a capillary 23 in its bottom. A needle 24 of platinum extends vertical through the capillary 23 in the reservoir 19. The needle 24 has one end spot-welded to the metal plate 21 and the other end disposed above an extracting electrode 25 in confronting relation. The end of the needle 24 which faces the extracting electrode 25 is tapered as by etching so that it has a diameter of 1 micron. Tungsten filaments 26, 27 have ends spot-welded to the metal plates 21, 22 and the other ends welded to stems 29, 30, respectively, fixed to a plate 28 of glass. The metal plates 21, 22 and the filaments 26, 27 are covered with a ceramics coating 31. The stems 29, 30 are connected to an extracting voltage supply 32 and an accelerating voltage supply 33, so that an extracting voltage in the range of from 5 KV to 10 KV will be applied between the needle 24 and the extracting electrode 25, and an accelerating voltage ranging from 20 KV to 100 KV will be applied between the needle 24 and a grounded electrode 34, for thereby forming an intensive electric field at the tapered end of the needle 24.

In operation, the tungsten filaments 26, 27 are heated by an electric current supplied from a heating power supply 10 between the stems 29, 30. As the filaments 26, 27 are heated, the body 20 of alloy (Pt-B) contained in the reservoir 19 is heated by heat conducted from the filaments 26, 27. When the alloy (Pt-B) is heated to its melting point, it is turned into a liquid state. The liquid alloy in the reservoir 19 is drawn under the intensive electric field at the apex end of the needle 24 through the capillary 23 in the bottom of the reservoir 19 toward the pointed end of the needle 24. The liquid alloy forms a conical projection or Taylor's cone on the needle end under the electric field applied, the conical projection having a tapered end of a small diameter of about 0.03 micron. The electric field is concentrated on the tapered end of the conical projection, from which the liquid alloy is evaporated under the electric field and ionized to produce ions of Pt and ions of B which are accelerated toward the grounded electrode 34. The accelerated ions are led to a Wien-type mass filter (not shown) disposed below the grounded electrode 34 so as to separate B ions for use as a material to process other materials.

With the ion source thus constructed, the diameter of the ion generator is quite small as it is substantially equal to that of the distal end of the conical projection formed by the liquid alloy on the tapered end of the needle 24, and an intensive electric field can be produced in the vicinity of the distal end of the conical projection. The ion source can therefore generate an ion beam of a high brightness, and is suitable for use in treatment steps such as ion beam exposure and ion implantation in the VLSI fabrication process. With the illustrated embodiment, the needle 24 is made of platinum, and there is no danger for the platinum material on the surface of the needle 24 to be melted into the platinum-based eutectic alloy Pt-B which is in the liquid phase. The composition of the liquid alloy thus remains unchanged throughout the operation of the ion source over a long period of time. The alloy Pt-B can stably be supplied to the tapered end of the needle 24 without being solidified as long as the alloy is heated at a temperature higher than its melting point. While in the foregoing embodiment an eutectic alloy of platinum and boron is used as the alloy 20 and the needle 24 is made of platinum, other materials may be used. For example, an eutectic alloy of gold and silicon (Au-Si) may be used for the alloy 20, and gold may be employed for the needle 24. As an alternative, an alloy of Pb-Ni-As may be used for the alloy 20 to suit some applications.

Since the reservoir 19 is made of ceramics, it will not react with and hence be melted into the liquid alloy 20 contained in the reservoir 19, an arrangement which also serves to maintain the components and composition of the alloy constant for a prolonged period of time. The ceramic coatings on the filaments 26, 27 and the metal plates 21, 22 prevent the materials of the filaments and metal plates from being melted into the liquid alloy which has reached the filaments and metal plates due to thermal diffusion.

As a modification of the ion source shown in FIG. 6, a core portion of the needle 24 may be made of ceramics or some other material, and may be coated with a layer of platinum Pt which is a component of the alloy Pt-B to be ionized. Alternatively, the needle 24 may be made of ceramics only.

According to another modification, the reservoir 19 may be made of metal such as tantalum, and may be coated with a layer of platinum (Pt), a component of the alloy Pt-B which is to be ionized.

Although certain preferred embodiments have been shown and described, it should be understood that many changes and modifications may be made therein without departing from the scope of the appended claims.

We claim:

1. A metal ion source comprising:

(a) a funnel-shaped reservoir vessel for containing liquid metal to be ionized, said reservoir having in its bottom a capillary bore, said bottom and bore extending outwardly in symmetrical relation to an optical axis of the metal ion source;

(b) a needle extending coaxially through said capillary bore in said reservoir making no contact therewith and having a pointed end projecting beyond an outer surface of said reservoir;

(c) a plurality of conductive wires supporting said reservoir and conducting electrical current thereto;

(d) an extracting electrode having an opening and being disposed facing said capillary in said reservoir;

(e) a grounded electrode disposed below said extracting electrode;

(f) a DC voltage supply for maintaining said reservoir at a positive high potential with respect to said grounded electrode;

(g) an extracting voltage supply for maintaining said extracting electrode at a negative potential with respect to said reservoir; and (h) a heating power supply for supplying an electric current through said plurality of wires to heat said reservoir.

2. A metal ion source according to claim 1, wherein said plurality of wires are at least partly coated with a material which is poorly wet by the liquid metal contained in said reservoir.

3. A metal ion source according to claim 1, wherein said reservoir is at least partly coated with a material which is poorly wet by the liquid metal contained in said reservoir.

4. A metal ion source according to claim 1, wherein said wires are shaped to provide a region which is heatable to a temperature higher than that of the rest of the filaments.

5. A metal ion source according to claim 4, wherein said wires have a coil-shaped portion.

6. A metal ion source according to claim 4, wherein said wires have a U-shaped portion.

7. A metal ion source according to claim 1, wherein said wires are made of a material having a temperature coefficient of resistance which is $0.5\times10^{-3}$/degree Celsius or smaller.

8. A metal ion source according to claim 7, wherein said wires are made of a nickel-chromium alloy or an ion chromium alloy.

9. A metal ion source according to claim 1, wherein said needle has a surface made of a component of an eutectic alloy contained in said reservoir.

10. A metal ion source according to claim 1, wherein said reservoir has a surface made of a component of an eutectic alloy contained in said reservoir.

11. A metal ion source according to claim 2 or claim 3, wherein the coating material is comprised of ceramic material.

12. A metal ion source according to claim 1, wherein the reservoir is at least partially formed of a ceramic material.

13. A metal ion source according to claim 1 wherein the outer shape of the reservoir comprises a conical surface symmetrical with the optical axis.

* * * * *